United States Patent [19]

Young, Jr.

[11] 4,447,937

[45] May 15, 1984

[54] WEB EDGE DECURLING DEVICE

[75] Inventor: William O. Young, Jr., Spartanburg, S.C.

[73] Assignee: Young Engineering, Inc., Spartanburg, S.C.

[21] Appl. No.: 273,084

[22] Filed: Jun. 12, 1981

[51] Int. Cl.[3] ..... D06C 25/00

[52] U.S. Cl. ..... 26/98

[58] Field of Search ..... 26/98, DIG. 1; 139/292, 139/293; 38/143; 242/154

[56] References Cited

U.S. PATENT DOCUMENTS 3,201,298 8/1965 Baker et al. ..... 242/154 X
4,217,682 8/1980 Young, Jr. et al. ..... 26/98

FOREIGN PATENT DOCUMENTS 276759 7/1914 Fed. Rep. of Germany ..... 26/98
749679 5/1933 France ..... 26/DIG. 1
263969 4/1929 Italy ..... 26/98
117427 7/1918 United Kingdom ..... 26/DIG. 1

*Primary Examiner*—Robert Mackey
*Attorney, Agent, or Firm*—Wellington M. Manning, Jr.; Luke J. Wilburn, Jr.

[57] ABSTRACT

A device for removing curl, folds and the like from a moving web in which elongated fins associated with top and bottom plates cooperate to define a web passageway therebetween. The top plate is preferably associated with the bottom plate such that the top plate is biasable away from the bottom plate by seams, etc., passing therebetween, and may include quick release coupling to facilitate assembly and disassembly of the device without affecting the process with which the device is employed. Relative positions of the top and bottom fins may be adjustably controlled. Preferred different fin spacing permits the handling of webs of varying weights and constructions.

28 Claims, 9 Drawing Figures

WEB EDGE DECURLING DEVICE

BACKGROUND OF THE INVENTION

Textile webs in general are subject to curling along an edge or selvage thereof while being handled in open width and often develop curls, pressed folds or creases therealong due to improper handling, web tension, or the like. Knit or other flimsy textile webs in particular, when processed or handled at low tension or generally tensionless conditions tend to curl or roll up along the selvage. In order to produce a good quality roll of a textile web, or to achieve proper web handling along a process line for printing, inspection, drying, extraction of moisture, washing, doubling, tacking or other web treatment, it is most desirable, if not necessary, to ensure that the web is maintained in a flat condition where little or no fabric deformation is present at either selvage during winding or processing as set forth above. Proper package preparation or web handling may thus be achieved in conjunction with apparatus of the present invention that engages the web selvage and due to a particular action, removes curl, folds and creases from the selvage of the web. While the device of the present invention is suitable for curl, fold and crease removal, hereinafter, decurling is intended to refer to all.

Several different classes of decurling devices have heretofore been developed that include static as well as power driven approaches. Among the power approaches to decurling, exemplary of same are a driven type where oppositely opposed discs, rotating fingers, screws, belts or the like are located along a selvage of the web. The elements are driven to produce a motion which, in turn, imparts a spreading effect to the web to remove the curl. Likewise, fluid jets have been directed against the web curl to apply a decurling or uncurling force thereon. The power driven approach to decurling of necessity, requires a motive force for driving the particular decurling elements. Such obviously adds to cost of operation and likewise, leads to the necessity for continuing maintenance and replacement of parts, not to mention a significant initial capital cost.

The improved decurling device of the present invention is a static type structure. Known static systems include principally the decurler described in U.S. Pat. No. 4,217,682 to Young et al over which the present invention represents improvement. The Young et al web edge decurler has been commercially successful and performs the decurling operation in a very suitable fashion. Other known static systems include a pair of spring loaded elements that are disposed above and below the web, with each of the elements being U-shaped where a short leg of the U is presented on the web side and engages the web to strip curl therefrom. Still further, another known static structure includes a planar surface having ridges disposed thereon over which the web passes, with frictional forces produced between the web and the ridges to remove curl from the selvage of the web. Still other decurling devices are disclosed in British Pat. Nos. 105,895 to Canby et al and 117,427 to Greenwood, and in German Pat. No. 276,759 to Spuhr.

Decurling devices according to teachings of the present invention represent definite technological advance in the art which is not believed to be taught or suggested by any of the prior art set forth above, or by any other known prior art.

SUMMARY OF THE INVENTION

It is an object of the present invention to provide a device for removing curl, folds and the like from the edge of a moving web.

Another object of the present invention is to provide an improved static device for flattening the selvage of a traveling web to provide a uniform web surface thereat.

Yet another object of the present invention is to provide an improved device for decurling an edge of a moving web that may be positioned immediately adjacent further processing equipment.

Still another object of the present invention is to provide an improved edge decurling device that is uniquely adjustable and is capable of removing all types of curl from the selvage of a wide range of fabrics.

Still another object of the present invention is to provide an improved edge decurling device that may be quickly and easily disassembled to facilitate cleaning and/or inspection of same when necessary.

Yet another object of the present invention is to provide an improved web decurler that is suitable for use in conjunction with a tenter frame and which will accept seams in the fabric being handled without disturbing the tentering operation.

Generally speaking, the device of the present invention for removing curl, folds and the like from an edge of a moving web comprises a top plate, said plate having a plurality of parallel elongated fins associated therewith, said fins being disposed at an angle to an edge of a web traveling thereby, said fins having a smooth angled edge for contact with said web; a bottom plate, said bottom plate having a plurality of elongated fins associated therewith, said fins being disposed at an angle to an edge of a web traveling thereby, said fins having a smooth angled edge for contact with said web and being located immediately adjacent said fins associated with top plate, means to associate said plates whereby said top and bottom fins define a web passageway therebetween; and a plurality of adjustment means located between said top and bottom plate for positionally adjusting the fins associated with said top plate respective to the fins associated with said bottom plate, at least certain of said plurality of adjustment means being interrelated such that adjustment of one of said means simultaneously adjusts other of said at least certain means.

Additionally, the plate association means may be quick release coupling means such that the top and bottom plates may be easily and quickly disassembled for cleaning, inspection or other desirable reasons followed by easy recoupling with a minimum of disruption of process equipment with which the unit is being utilized.

In another embodiment of the instant decurler device, the fins are arranged to accommodate a wide range of fabric weights and constructions. Particularly, such embodiment includes providing a plurality of banks of fins with different spacing between fins in at least certain of the various banks. A first or entrance bank of fins is provided having a fin spacing adequate to accept heavy type webs and initiate decurling of same while also being close enough together to have some initial decurling effect on lighter types of fabric webs. At the exit to the decurler the banks of fins is provided with lesser space between the fins to complete the decurling action for both types of webs. Preferably for tenter frame applications, the bank of fins are separated with an opening through the top and bottom plates located above and below the separation, and through which a sensing mechanism may detect the presence or absence of an edge of the web being decurled for proper positional location of same with respect to the pins or clips of the tenter.

More particularly, the novel adjustment feature of the present invention preferably includes a plurality of elements or studs associated with one of the bottom and top plates and making contact with the other of said plates. The elements are adpated for movement to and from the plate with which they are associated to vary the spacing between the plates and thus define the web passageway between the fins according to the dictates of the material being processed. The adjustment studs are preferably received in a housing secured to one of the plates with an opposite end of at least certain of the studs being receivable in appropriate receiving means at the other of said plates whereby relative lateral movement between the two plates is precluded. In a most preferred arrangement, the adjustment studs are received in a housing secured to the inside surface of the top plate, with each of the studs being received in an appropriate opening within the housing, a portion of which is threaded, and wherein a portion of the length of the stud is threaded for mating engagement with the threaded portion of the housing. The studs are all interengaged by virtue of a drive means making contact therewith, with one of the studs passing through the top plate and being adapted for manual adjustment thereat. Once manual adjustment is made to the one stud, all of the interrelated studs in the housing, through the drive means, are simultaneously adjusted by a like amount. Three such studs may be provided in a triangular pattern with two of the studs located on a line parallel to an outer edge of the decurler and the third, manually adjustable stud being located on a line with one of the first two studs, generally parallel to an entrance to the decurling unit.

In one embodiment of the quick release coupling means for the decurler of the present invention, an elongated element is received through one of the two plates, preferably the top plate, and has a spring means located between the outer surface of the plate and an outer end of the element. An element receiving means is presented at an opposite location on the inside of the opposite plate. When the plates are brought into proper alignment, the elongated element may be depressed against the bias of the spring means, received in the element receiving means in releasable locking engagement, to interlock the top and bottom plates. Disassembly of the top and bottom plates would follow the reverse, i.e., depression of the elongated element in a direction of the plate and manipulation to release same from the receiving means, whereby the two plates may be easily and quickly separated for cleaning, inspection or the like. Preferably in such arrangement, the connector means are located adjacent the adjustment means, at an outer end of the decurler, with the other or opposite end of the decurler being devoid of internal support. With the coupling means properly located, the top plate of the device, along the operative length of the decurler, in effect, floats above the bottom plate and is biasable apart from the bottom plate by seams or other imperfections in the web that pass through the device without interfering with the operation of the device or of processing equipment in connection with which the device is being employed.

In a further embodiment of the quick release coupling means that may be utilized to associate the top and bottom plates of the device, spring means may be secured to one of said plates and extend outwardly towards the other of said plates having a handle means secured to an opposite end of the spring and being contoured to reside, in part, beyond the other of said plates. The handle means has a pressure element secured thereto which extends inwardly towards said other of said plates, whereby when said plates are properly aligned, said spring means biases said pressure means against an outer surface of the opposite of said plates, to hold said plates in operative association. With such arrangement, preferably the pressure means makes contact with the outer surface of the other of said plates at a generally central location with respect to the width of the plate, adjacent an edge of same away from the operative decurling portion of the device. A further, counter spring means may be provided between the plates adjacent the same end of the plate where the pressure element is located, the further spring means providing a spring bias against the pressure element. The relative spring pressures and location of the operative spring elements are preferably such that the operative end of the top plate freely floats above the bottom plate permitting a seam or other web imperfection to pass through the device without disrupting normal operations. For disassembly of the device, an upward lifting motion of the handle removes the pressure element from contact with the other plate, permitting the other plate to be raised slightly, adequate for lateral movement from beneath the pressure element and apart from the bottom plate.

DESCRIPTION OF THE PREFERRED EMBODIMENTS

Figure 1:
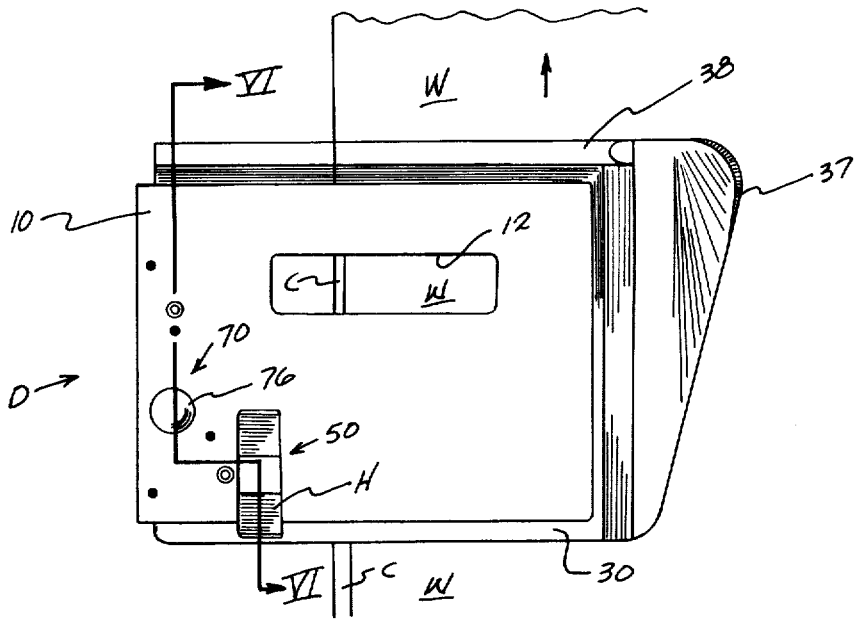
FIG. 1 is a top plan view of a decurling device according to teachings of the present invention.

Making reference to the Figures, preferred embodiments of the present invention will now be described in detail. Insofar as the overall decurler unit is generally concerned, except where inconsistent herewith, the individual elements may be provided as disclosed in U.S. Pat. No. 4,217,682 to Young et al, which is incorporated by reference herein. Operationally speaking, two decurler units D may be located along opposite sides of a passageway for a web W of textile material illustrated for one side only in FIG. 1. Decurler units D may be mounted by means illustrated in FIGS. 2 or 3 as described hereinafter or by any other suitable means. Web edge detector means P may be located along at least one of the outer edges of said passageway (See FIG. 2), such that when utilized in conjunction with means to move the web in a lateral direction upon receipt of a signal from the detector means P, the web may be generally maintained properly with respect to the operative decurling zone of units D for removal of curl C from web W and/or the processing equipment.

In FIGS. 1–6, one preferred embodiment of the decurler unit of the present invention is set forth. The decurling device D of the present invention generally includes a top plate 10 having a group of fins generally 20 associated with an inside surface of same and a bottom plate 30 having a group of fins generally 40 associated with an inside surface of same. Fins making up groups 20 and 40 are preferably secured to the inside surfaces of plates 10 and 30 respectively, and are presented at an angle to a passageway for web W through device D, extending towards an outer edge of device D. When plates 10 and 30 are associated such that groups of fins 20 and 40 are located adjacent each other, a web passageway is defined therebetween through which web W may pass for removal of curl, folds, creases and the like C therefrom. Plates 10 and 30 are held in operative association by a coupling means generally 70 and the particular passageway defined by fin groups 20 and 40 may be set by adjustment means generally 50.

Figure 4:
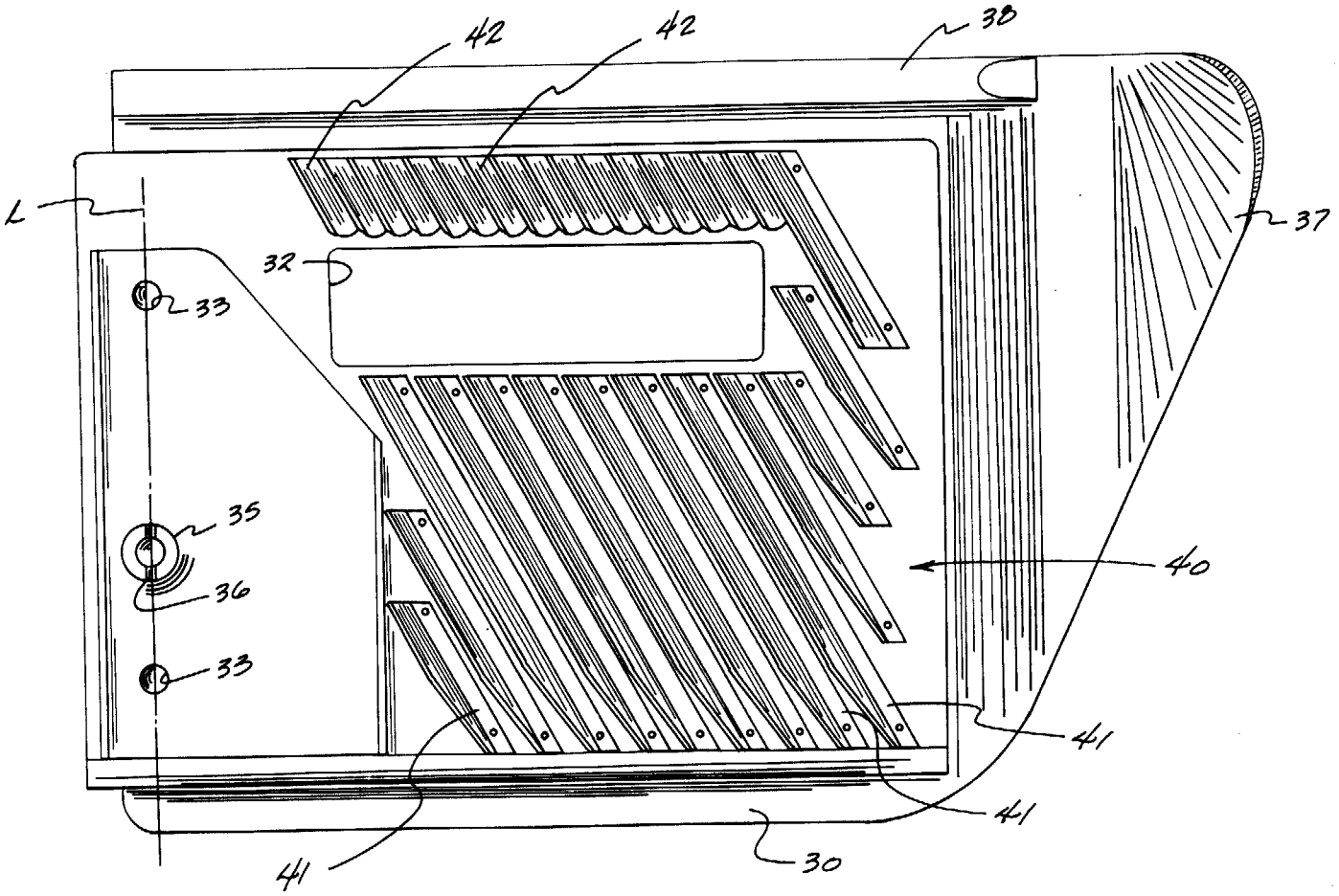
FIG. 4 is a plan view of the inside of the bottom plate of a preferred embodiment of the present invention.
Figure 5:
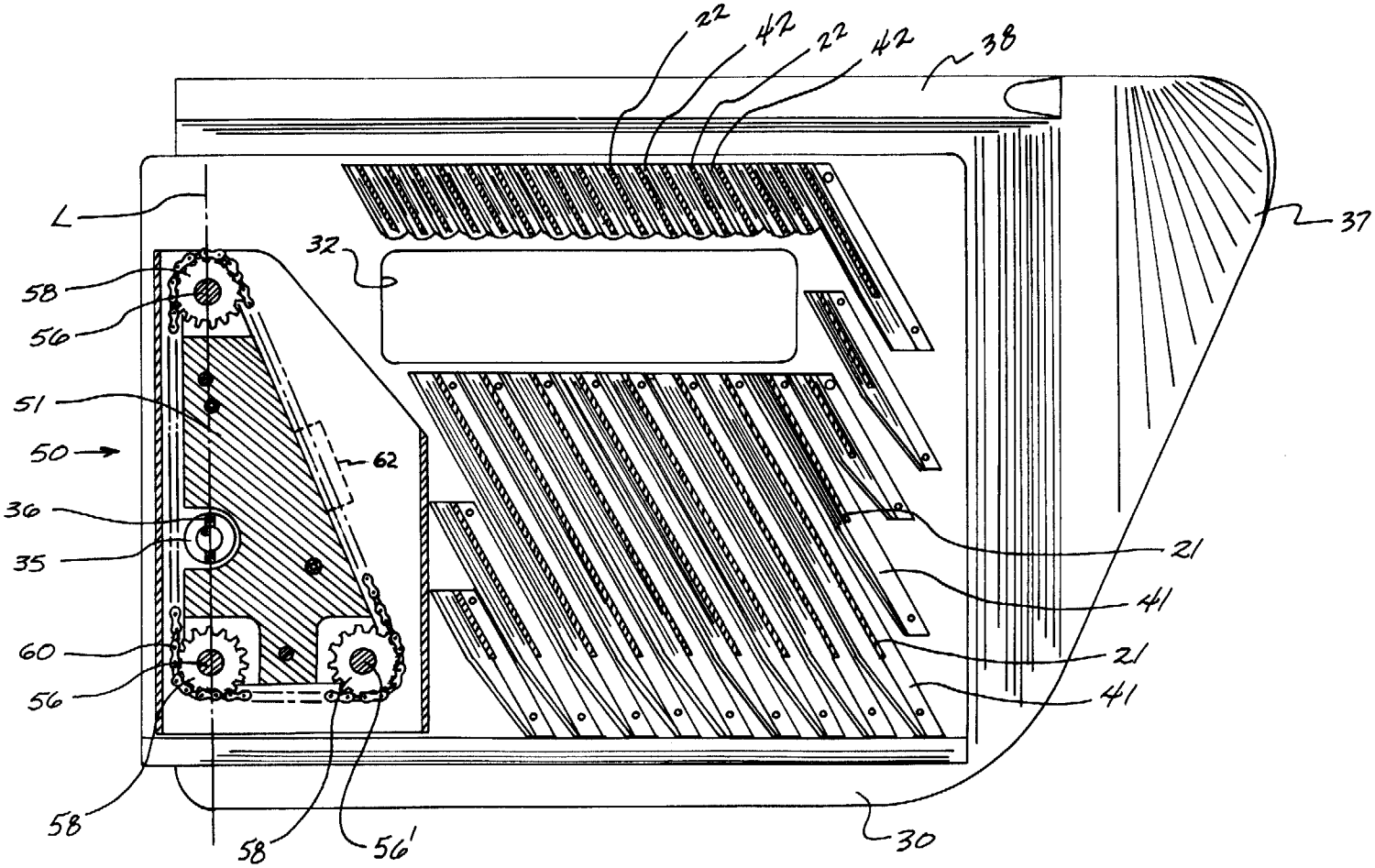
FIG. 5 is a horizontal cross-sectional view of the device as illustrated in FIG. 2, taken along a line V—V.

As particularly illustrated in FIG. 4, which is a plan view of bottom plate 30, fin group 40 is provided by a plurality of banks of fins 41 and 42, all of which extend in an angular direction towards an outer edge of the web passageway, with each fin being spaced apart from an adjacent fin by a predetermined distance. Fin group 20 associated with the inside of upper plate 10, likewise is provided by a plurality of banks of fins 21 and 22 which, when superimposed above fin group 40 likewise extend angularly outwardly towards the outer edge of a web passageway. In a most preferred embodiment as illustrated in FIG. 5, fins 21 and 22 when superimposed above fins 41 and 42 are vertically offset therefrom. A tortuous passageway may be provided through the decurler unit where the vertical spacing between fins of the respective plates is such that the fins intermesh. With a fin bank arrangement of the type illustrated in FIGS. 4 and 5, webs of varying weights and constructions may be processed therethrough. Fins 21 and 41 at the entrance to the device are spaced apart from adjacent fins 21 and 41 at a distance that will initiate a decurling action for both light and heavy webs, while fins 22 and 42 located at the exit end of the device have a lesser spacing than between fins 21 and 41 to finalize the decurling action.

In general, the fins utilized in the instant decurler device are preferably tapered along an end of same adjacent an entrance to the decurler unit or an interior bank of fins to facilitate ingress of a web therebetween. All web contact surfaces of the fins are smooth to avoid damage to the web, and in a most preferred embodiment, the fins do not extend away from the respective plates in perpendicular fashion, but are canted in the direction of the outer end of same, i.e., the end of the unit that will be disposed beyond the outer edge of the web passageway. Further, while the fins are illustrated herein as individual elements, spot welded to the respective plates, obviously the fins may be provided in any suitable manner, certain of which are set forth in the previously referred to U.S. Pat. No. 4,217,682.

Specifically as to the device illustrated in FIGS. 1–6, for tenter frame use, top plate 10 defines an elongated opening 12 which is located directly above a like opening 32 defined by bottom plate 30 and through which a web being handled may be visually observed or detected by suitable detection means P. In a most preferred arrangement (See FIGS. 4 and 5), the fin group 40 associated with bottom plate 30 is provided in two banks, one of which includes fins 41 and the other, fins 42, with the two banks being generally separated by opening 32 defined by plate 30. Fins 41 that make up one of fin banks, adjacent an entrance to the device, are spaced apart from adjacent fins 41 by an amount adequate to accept and begin to remove curl, folds, creases and the like from a generally heavy type web, whereas fins 42 that make up the other of the fin banks are spaced apart from adjacent fins 42 by a lesser amount, adequate to further remove curl, folds, creases and the like from either a light or flimsy web or from a heavy web from which most of the curl has already been removed by the wide spaced entry fins. As mentioned hereinbefore, a common spacing between fins throughout a decurler is illustrated in U.S. Pat. No. 4,217,682. Commercially a certain spacing between all of the fins of a decurler has been provided when the decurler is intended primarily for use on heavy type webs, with a lesser spacing between all the fins of a decurler intended for use on light or flimsy type webs. While the same approach may be taken for the decurler of the present invention, utilizing a plurality of banks of fins as described, supra, the device of the present invention is generally suitable for handling all types of webs as mentioned above. A like arrangement is provided on the underside of top plate 10 where a first bank of fins 21 is provided adjacent the entrance to the device having a wide spacing between adjacent fins with a second bank of fins 22 being provided adjacent the exit from the decurler having a lesser spacing therebetween. Such is illustrated in FIG. 5 where fins 21 and 22 are shown in cross section, intermeshing with fins 41 and 42 of bottom plate 30.

Located between top and bottom plates 10 and 30 is an adjustment means generally 50. Adjustment means 50 includes a housing 51 (See FIGS. 5 and 6) that is secured to an inside of top plate 10 and has a plurality of stud receiving openings 52 therethrough, coincident with the number of adjustment studs 56 utilized in the particular device. A portion of the length of openings 52 through housing 51 is threaded at 53 while a further portion of the opening 52 serves as a bearing surface for studs 56 as at 54. One of openings 52 in housing 51 is aligned with an opening 13 defined by top plate 10 for a purpose to be described hereinafter.

A plurality of adjustment studs 56 are received within openings 52 of housing 51, with one adjustment stud 56' extending upwardly through opening 13 of plate 10 and having an adjustment means H illustrated as a handle secured thereto. Studs 56 are threaded along a portion of the length of same at 57 to be received in threaded connection with the threaded portion 53 of openings 52. Beneath the threaded portion 57, a sprocket or other similar means 58 is provided on studs 56 with drive sprocket 58 residing within a recess 59 therefor in housing 51 and in operative association with a drive means 60 as defined hereinafter. Below sprocket 58, studs 56 are received for rotation in bearing surface 54 of housing 51. A lower portion 61 of studs 56 engages a portion of bottom plate 30 with at least certain of studs 56 being received in stud receiving openings 33 located on the inner surface of plate 30. Manually adjustable stud 56' may only make contact with a portion of plate 30. With at least two studs 56 received in respective stud receiving openings 33, lateral movement of plate 10 with respect to plate 30 is precluded.

As illustrated particularly in FIG. 5, in a preferred arrangement, housing 51 is generally triangular shaped, and is located immediately adjacent an edge of plate 10, outside of the path of travel of a web through the device, with each of the studs 56 and 56' being located at a corner of same. Particularly, two studs 56 are located in a line L parallel to an outer end of the device and consequently an outer end of plate 10 while the third, manually adjustable stud 56' is located inwardly with respect to said parallel line and in a line with one of said two studs 56, parallel to the entrance to the decurling device. Line L defines a hinge location for top plate 10 with respect to bottom plate 30, the purpose of which will be described hereinafter. A drive means 60, such as a chain, timing belt or the like passes around sprockets 58 of studs 56 and 56' to interrelate same. When handle H of the manually adjustable stud 56' is rotated to provide adjustment for adjustment stud 56', studs 56 move up or down a like amount such that the positional relationship between the outer web contact surface of the fins associated with plates 10 and 30 may be set at a predetermined position.

In a preferred arrangement for operation of the decurler according to the present invention, there is a slightly greater vertical spacing between the respective fins 21 and 41 at the entrance end of the decurler than at the exit end to facilitate ease of entry of the web W thereinto. Such differential spacing may be preset into the device by particular original placement of the adjustment studs 56 and 56', after which, during adjustment, the preset differential spacing will be retained.

While the innermost stud 56' is disclosed as the adjustment stud for the simultaneous adjustment means 50 of the present decurler, obviously any of the other studs could likewise serve as such. Furthermore, with a chain drive means 60 being received around sprockets 58, in a most preferred embodiment, chain 60 is an inextensible, link chain. Should, however, a drive connector 60 be utilized that is not inextensible, a drive means tension control element 62 shown schematically in phantom in FIG. 5, could be employed. In similar fashion, while sprockets are illustrated as a preferred arrangement for interconnection between the drive means and the individual studs, sheaves, pulleys or the like could likewise be suitably employed, so long as same could be utilized in conjunction with drive means 60 without slippage.

Figure 6:
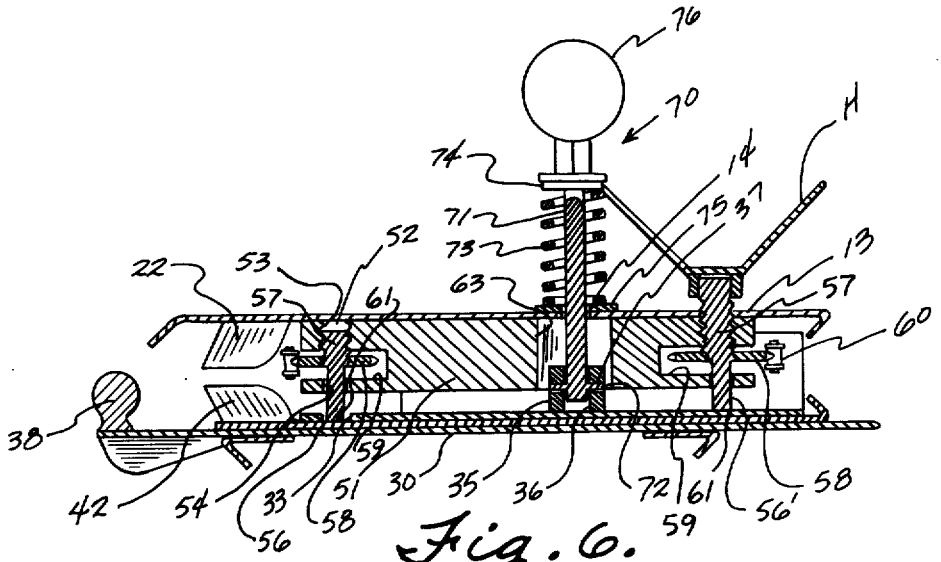
FIG. 6 is a vertical cross-sectional view of the device as illustrated in FIG. 1, taken along a line VI—VI.

As illustrated in the Figures, particularly FIG. 6, the quick release coupling means generally indicated as 70 is located within the area of the adjustment means, and is illustrated in FIG. 6 as an elongated element 71 that extends through an opening 14 in top plate 10, and an opening 63 in housing 51, and has a latch means 72 located adjacent a terminal end of same. Latch means 72 is preferably a member that extends outwardly from both sides of element 71, transverse to the length of same. A latch receiving means 35 is associated with bottom plate 30 to receive latch means 72 and defines a vertical slot 36 therethrough. Along the length of vertical slot 36 is an internal, horizontal slot 37 into which latch means 72 may be removably received against inadvertent removal, whereby top plate 10 may be secured to bottom plate 30 with the adjustment studs 56 being received in the stud receiving means 33. A spring means 73 is located along element 71, between a pair of retainers 74 and 75 to provide a spring bias on latch means 72, holding same against a portion of receiving means 35 that defines an upper wall for horizontal slot 37. As illustrated, an appropriate handle means 76 is located above the spring means 73 to facilitate depression and rotational movement of quick release coupling 70.

Latch means 72 is larger than opening 14 in top plate 10 whereby element 71 remains in place with respect to top plate 10. When it is desirable to associate decurler plates 10 and 30, the plates are brought into proper alignment such that studs 56 are received in stud receiving means 33 and latch means 72 resides in vertical slot 36 of receiving means 35. Depression of handle 76 of coupling means 70 compresses spring means 73 and moves latch means 72 inwardly of slot 36 of latch receiving means 35 to horizontal slot 37. Rotation of element 71 then moves latch means 72 into horizontal slot 37, and once pressure is removed from handle 76, spring 73 expands applying tension on latch means 72, holding same therein.

Once it is desirable to detach top plate 10 from bottom plate 30, it is simply necessary to again depress handle 76 and rotate same adequate to permit latch means 72 to be returned from horizontal slot 37 into entrance slot 36 of latch receiving means 35. Handle 76 is then released and plate 10 can be moved away from plate 30. With vertical slot 36 aligned as illustrated in the figures, parallel to an outer edge of the decurler, top plate 10 may be moved laterally away from bottom plate 30 with little or no vertical displacement. Such is advantageous where, for example, in conjunction with a tenter frame, a sensor P is located above the decurler. In this particular arrangement, quick release coupling means 70 is preferably located adjacent the outer edge of the decurling device, beyond the path of travel of the web with no further internal support other than adjustment means 50, such that top plate 10 "floats" above bottom plate 30 to permit separational movement therebetween in the presence of a seam or other imperfection in the web without disrupting the downstream operation of the processing equipment. Specifically, as illustrated in the Figures, coupling means 70 is preferably located along line L (See FIGS. 4 and 5), the general hinge line between plates 10 and 30, whereby top plate 10 floats above bottom plate 30. With coupling means 70 so positioned, no further internal support is generally necessary or desired. Coupling means 70 may, however, be moved off line L, and if the movement of same is of adequate magnitude, or if the weight of top plate 10 dictates, an internal counter spring means such as at 177 of FIG. 9 may be desired to facilitate the floating condition of top 10.

Figure 7:
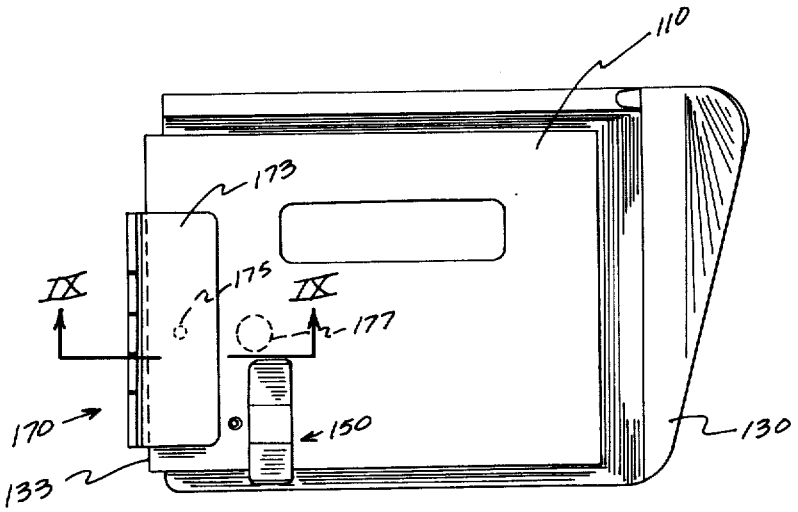
FIG. 7 is a top plan view of a further embodiment of a decurling device according to the present invention.
Figure 8:
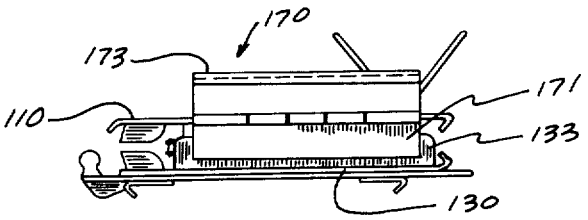
FIG. 8 is an end elevational view of the decurler illustrated in FIG. 7.
Figure 9:
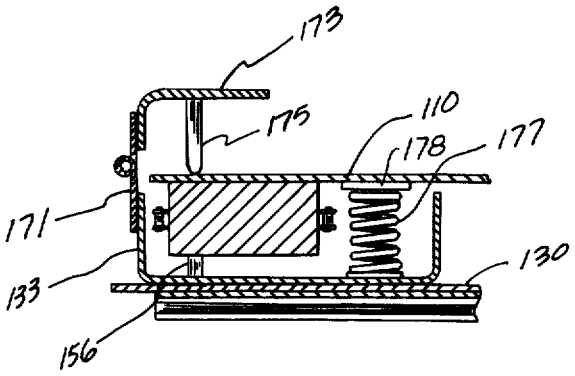
FIG. 9 is a partial vertical cross sectional view of the decurler illustrated in FIG. 7 taken along a line IX—IX.

A further embodiment of a quick release coupling means for the present decurler is illustrated in FIGS. 7, 8 and 9. A decurler device is provided having a top plate 110 and bottom plate 130, both of which are provided with a fin arrangement as shown in U.S. Pat. No. 4,217,682, or as specifically illustrated and described herein, with a web passageway defined by relative fin position. In like fashion, adjustment means generally 150 are likewise preferably provided. Bottom plate 130 has one end of a spring means 171 secured along a paricular length of an end edge 133 thereof. A handle means 173 is secured to an end of spring 171 opposite its securement to edge 133. Handle means 173 extends over an outer surface of top plate 110 and has a pressure element 175 secured thereto and depending therefrom in a direction toward top plate 110. Spring means 171 provides a bias to handle means 173 in a direction of top plate 110, whereby pressure element 175 transmits said spring bias to top plate 110 to hold plate 110 in association with bottom plate 130. Preferably pressure element 175 is located on handle means 173 to make contact with plate 110 and 130 to hold plates 110 and 130 at a proper decurling relationship. As shown in FIGS. 7 and 9, counter spring means 177 is located adjacent the adjustment means 150, whereby the portion of the decurler within the fin area has no internal support and top plate 110 floats above plate 130 for the purposes described hereinbefore. In like fashion, counter spring means may be located at different positions between plates 110 and 130, for differing degrees of influence on the effect of the biased pressure element 175. In all arrangements, however, counter spring means 177 when utilized will be located outside the fin area. Counter spring means 177 is preferably secured to an inside surface of one of the plates, preferably bottom plate 130 and has a plate 178 received at an opposite end, contactable with an inside surface of the opposite plate.

Assembly of the embodiment illustrated in FIGS. 7 through 9 involves lifting of handle means 173 by an amount adequate to permit top plate 110 to be moved laterally thereunder until adjustment studs 156 are aligned with receiving means therefor (33 of FIG. 4). Handle means 173 is then released and pressure element 175 is biased by spring 171 into pressure contact with the outside surface of top plate 110, and against the bias of counter spring 177. To disassociate the plates for cleaning or the like, the reverse procedure is followed, all of which may be conveniently accomplished without disruption of placement of plate 130.

In further description of the decurler according to teachings of the present invention, certain additional features should be alluded to with respect to top plate 10 and bottom plate 30. Note, for example, in FIGS. 1, 2, 4 and 5, that bottom plate 30 has an extension wing element 37 that resides on the inside of the decurling unit, beneath the pathway of a web passing thereover. Wing element 37 is particularly contoured in an arcuate fashion extending downwardly with respect to the path of travel such that a web exiting from the decurler unit may follow a downward path of travel, making contact with the downward contour of wing 37 without a danger of wing 37 creating marks on the web or distorting same. In similar fashion, with particular reference to FIGS. 1 and 3, a horizontal web support bar 38 is provided adjacent an exit from the decurling device to afford support to a web exiting therefrom without the danger of same being marked or otherwise affected.

Figure 2:
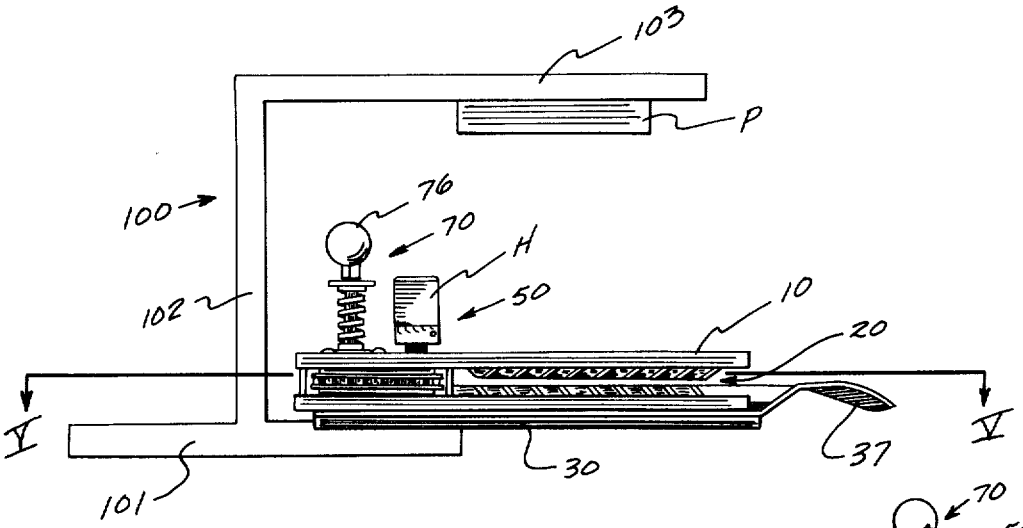
FIG. 2 is a side elevational view of the decurling device as shown in FIG. 1, viewed from the web entrance side of same, and further illustrating a suitable means for mounting the decurling device and a web sensor.
Figure 3:
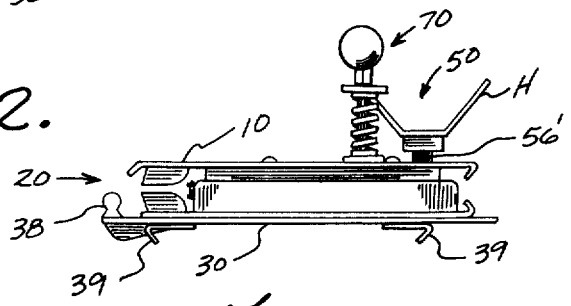
FIG. 3 is an end elevational view of the decurler as illustrated in FIG. 1, viewed from the left side of FIG. 1 or the outer edge of the yarn passageway, and illustrating a further embodiment of a mounting means.

Two types of mounting means are illustrated in FIGS. 2 and 3 for the decurler device according to the present invention. In FIG. 3, for example, a pair of inturned flanges 39 are secured to the outer surface of bottom plate 30, i.e., the surface opposite the surface with which the fins are associated, defining a particular spacing therebetween, such that a support element (not shown) may be received in the space between flanges 39 to securely hold the decurler at a proper location while permitting lateral adjustment along the support to facilitate manual compensation for handling different web widths. In FIG. 2, a mounting means generally 100 is illustrated having a base 101, a vertical element 102 and a horizontally extending element 103. Base 101 and horizontally extending element 103 are parallel to receive the decurler unit therebetween while a further portion of base 101 extends outwardly from the decurling unit beyond the vertical support 102 and may be utilized to secure the overall structure to the process equipment. Upper horizontal element 103 is so positioned that a detector element 105 such as a photodetector P may be secured thereto being located over plate openings 12 and 32 for detection of a web passing through the decurling device. Should lateral adjustment of the decurling unit be necessary, such may be accomplished by varying the length of the base 101, or by utilizing clamps in conjunction with base 101 to secure the overall structure to the process equipment whereby clamps may be released and the base reclamped at a different location.

Having described the present invention in detail, it is obvious that one skilled in the art will be able to make variations and modifications thereto without departing from the scope of the invention. Accordingly, the scope of the present invention should be determined only by the claims appended hereto.

What I claim is:

1. A device for removing curl, folds and the like from an edge of a moving web comprising:

(a) a top plate, said plate having a plurality of elongated fins associated therewith, said fins being disposed at an angle to an edge of a web traveling thereby, said fins having a smooth angled edge for contact with said web;

(b) a bottom plate, said bottom plate having a plurality of elongated fins associated therewith, said fins being disposed at an angle to an edge of a web traveling thereby, said fins having a smooth angled edge for contact with said web;

(c) means to associate said top and bottom plates whereby said top and bottom fins define a web passageway therebetween; and (d) means for positionally adjusting the fins associated with the top plate relative to the fins associated with the bottom plate, said means comprising a plurality of adjustment members received between said plates, said members being operatively associated with one of said plates for movement toward and away from said plate and contactable with the other of said plates, said members being interrelated for simultaneous movement, one of said members extending from between said plates and having means associated therewith for manual movement of same, other of said members being located entirely between said plates; whereby movement of said one of said members will cause like movement of the other of said members to positionally adjust said fins.

2. A device as defined in claim 1 wherein each of said top and bottom plates have a plurality of banks of fins associated therewith, at least one bank of fins adjacent a web entrance to said device having a predetermined lateral spacing between adjacent fins while at least one second bank of fins is provided with a lesser space between adjacent fins.

3. A device as defined in claim 2 wherein said banks of fins associated with each plate are separated and said top and bottom plates define an opening therein, whereby a web passing therebetween may be observed from a position remote from said device.

4. A device as defined in claim 1 wherein said plate association means includes spring means, whereby said fins associated with said top and bottom plates are held at a predetermined relative location under spring tension thereby.

5. A device as defined in claim 1 wherein said fins associated with said bottom plate are vertically offset from said fins associated with said top plate.

6. A device as defined in claim 5 wherein said fins associated with said top plate are meshed with said fins associated with said bottom plate, whereby a tortuous web passageway is defined therebetween.

7. A device as defined in claim 1 wherein said plate association means are quick release coupling means, whereby said top and bottom plates may be easily disassociated and reassociated for cleaning without disrupting adjacent processing equipment.

8. A device as defined in claim 7 wherein said quick release coupling means comprises an elongated element associated with said top plate to reside above same and to extend through same, and wherein said bottom plate has an element receiving means, said element having a spring means received therealong and located above said top plate, whereby upon alignment of said top and bottom plates, said element may be depressed and rotated into removable engagement against the bias of said spring means to secure said top and bottom plates together.

9. A device as defined in claim 8 wherein said quick release coupling means are located adjacent an edge of said device disposed outside the edge of a web to be treated thereby, whereby the top plate of said device adjacent an end opposite said quick coupling means is not associated with said bottom plate.

10. A device as defined in claim 1 wherein said plurality of adjustment members comprises at least two studs that are threadably associated with one of said plates and extend in a direction toward the other of said plates at which plate same are removably received against horizontal movement, said at least two studs having drive means interconnecting same, said one of said members extending from between said plates comprising a stud extending through the plate with which it is threadably associated and being associated with said manual moving means thereat, whereby when said one stud is manually rotated to cause same to move in a direction transverse to the plane of said plates, the other of said studs moves a like amount.

11. A device as defined in claim 10 wherein said three studs are operatively associated with one of said plates, two of said studs being disposed in a line generally parallel with an outer edge of said plates and the third of said studs being disposed inwardly from said edge in a line generally perpendicular to said edge, and wherein said drive means interconnects said three studs.

12. A device as defined in claim 11 wherein said studs have a sprocket received along the length of same and said drive means is an inextensible chain in operative association with said sprockets.

13. A device as defined in claim 11 wherein tension means are associated with said drive means to ensure simultaneous adjustment of all three studs.

14. A device as defined in claim 11 wherein said three studs are received in a housing secured to an underside of said top plate.

15. A device as defined in claim 14 wherein said innermost stud along said perpendicular line extends through said plate for manual adjustment.

16. A device as defined in claim 1 wherein said bottom plate extends beyond a portion of same having fins associated therewith and defines a web supporting wing, said wing being downwardly contoured in a direction of web travel upon leaving said device, whereby said wing element assists in supporting a web passing through said device and permits said web path to deviate after exit through said device without adverse affects thereto.

17. A device as defined in claim 1 wherein said plate association means comprises a spring biased handle means secured to a bottom of said plates and extending upwardly over said top plate, said handle means having a member depending therefrom into contact with said top plate.

18. A device as defined in claim 17 further comprising a counter spring means located between said top and bottom plates acting against the force of said spring biased handle means.

19. A device as defined in claim 17 wherein said spring biased handle means comprises a spring secured to said bottom plate along one end of same and a handle means secured to an outer end of said spring.

20. A device as defined in claim 19 wherein said member depending from said handle means makes contact with said top plate along a hinge line about which said top plate is biasable from said bottom plate.

21. A device for removing curl, folds and the like from an edge of a moving web comprising:

(a) a top plate, said top plate having a plurality of spaced apart elongated fins associated therewith, said fins being disposed at an angle to an edge of a web traveling thereby;

(b) a bottom plate, said bottom plate having a plurality of spaced apart elongated fins associated therewith, said fins being disposed at an angle to an edge of a web traveling thereby, an outer free edge along said fins of said top and bottom plates having a smooth web contact surface and being positioned adjacent each other; and (c) means to associate said top and bottom plates such that said top and bottom fins define a web passageway therebetween, said plate association means being located adjacent one end of said device only outside of said web passageway whereby an opposite end of said top plate is biasable in a direction away from said bottom plate without disruption of said device upon passage of a seam or other web imperfection therebetween, said plate association means comprising an elongated element disposed about an outer surface of one of said plates and extending therethrough, and wherein an opposite of said plates has an element receiving means associated therewith, said elongated element having spring means received therealong adjacent the outer surface of said one plate, whereby once said plates are brought into alignment, said elongated element may be depressed against the bias of said spring means and interengaged with said element receiving means into a removable locking relationship with the other of said plates; and (d) adjustment means located between said top and bottom plates for adjustment of the web passageway defined by the relative position of said fins associated with said top and bottom plates, and defining a hinge line about which said top plate is biasable away from said bottom plate.

22. A device as defined in claim 21 wherein said adjustment means comprise at least two studs threadably associated with one of said plates with mating with stud receiving elements associated with the other of said plates, said at least two studs being movable toward and away from said associated plate to increase and decrease the space between said plates.

23. A device as defined in claim 22 wherein three of said studs are present and are associated with an inside surface of said top plate, said studs having drive means interconnecting same and one of said studs extending through said top plate and being adapted for manual rotation thereat to move said stud toward and away from said top plate whereby rotation of said one of said studs simultaneously moves all of said studs by a like amount.

24. A device as defined in claim 23 wherein each of said studs is received in a housing secured to said top plate and extends therefrom to said bottom plate, said studs being threadably moveable with respect to said housing, and wherein each stud has a sprocket located along the length of same which is in operative association with said drive means.

25. A device for removing curls, folds and the like from an edge of moving web comprising:

(a) a top plate, said top plate having a plurality of banks of spaced apart elongated parallel fins associated therewith, said fins being disposed at an angle to an edge of a web traveling thereby;

(b) a bottom plate, said bottom plate having a plurality of banks of spaced apart elongated parallel fins associated therewith, said fins being disposed at an angle to an edge of a web traveling thereby; and (c) means to associate said top and bottom plates such that said fins on said bottom plates cooperate to define a web passageway therebetween, said banks of fins for said top and bottom plates including a first bank of fins adjacent a web entrance to the device in which each fin is spaced laterally apart from adjacent fins by a predetermined amount adequate to initiate decurling or flattening of heavier types of webs and a second bank of fins adjacent a web exit from the device in which each fin is spaced laterally apart from adjacent fins by a predetermined lesser amount than fins in said first bank to further decurl and flatten both heavy and light types of webs.

26. A device as defined in claim 25 further comprising means located between said plates to permit spacial adjustment therebetween.

27. A device as defined in claim 25 wherein said adjustment means comprise a plurality of threadably movable studs threadably associated with one of said plates and contactable with the other of said plates, said studs being movable toward and away from said plate with which same are associated, one of said studs being manually rotatable with the other adjustment studs interconnected therewith for a like rotation.

28. A device as defined in claim 25 wherein said plate association means comprise quick release coupling means.

* * * * *